United States Patent [19]

Neyret

[11] 4,049,370

[45] Sept. 20, 1977

[54] CIGARETTE LIGHTER WITH PRESALE TAMPER PROTECTION

[75] Inventor: Guy Neyret, Francheville, France

[73] Assignee: Societe Anonyme dite: Etablissements Genoud & Cie, Venissieux, France

[21] Appl. No.: 614,649

[22] Filed: Sept. 18, 1975

[30] Foreign Application Priority Data

Sept. 24, 1974 France ..... 74.32782

[51] Int. Cl.[2] ..... F23Q 25/00

[52] U.S. Cl. ..... 431/144; 431/150

[58] Field of Search ..... 431/150, 144, 154, 254; 222/153, 402.11, 541

[56] References Cited

U.S. PATENT DOCUMENTS 3,266,676 8/1966 McKernan ..... 222/541

3,938,943 2/1976 Malamoud ..... 431/150

*Primary Examiner*—Edward G. Favors

*Attorney, Agent, or Firm*—Karl F. Ross

[57] ABSTRACT

A cigarette lighter has a cylindrical fuel-containing housing provided at its head with a burner, a valve having a lever operable to feed fuel from the housing interior to the burner, and a striker wheel for sparking across the burner and igniting fuel issuing therefrom. A shield surrounds the projecting end of the valve lever and prevents its actuation. This shield is releasably connected to the housing by a plurality of frangible webs to allow its removal after purchase of the lighter. These webs are integrally formed with the shield and with the synthetic-resin reservoir body of the housing or with the metallic head cap thereof.

1 Claim, 2 Drawing Figures

CIGARETTE LIGHTER WITH PRESALE TAMPER PROTECTION

CROSS-REFERENCE TO RELATED APPLICATION

This application is related to my copending patent application Ser. No. 600,072 filed July 29, 1975.

FIELD OF THE INVENTION

The present invention relates to a lighter for a cigarette, cigar, or pipe and, more particularly to a lighter of the disposable gas type.

BACKGROUND OF THE INVENTION

A disposable gas-type lighter comprises a cylindrical synthetic-resin reservoir body containing a supply of fuel, usually butane. The head of this body is provided with a metallic cap and carries a burner, a valve operable by a laterally projecting lever to feed fuel from the reservoir to the burner, and an ignitor for sparking across the burner and igniting fuel issuing therefrom.

In order to reduce cost of this item to a minimum it has been suggested to market the item loose, unencumbered by any type of packaging. This suggestion has two principal drawbacks. First of all there is a safety hazard in that it is possible for a valve lever to be actuated accidentally, allowing potentially explosive gas to be released. Secondly the buyer is often not sure he or she is purchasing a brand new or virgin lighter, and this reduction in sales appeal makes the item hard to market.

OBJECTS OF THE INVENTION

It is therefore an object of the present invention to provide an improved lighter.

Another object is the provision of a disposable gas-type lighter which need not be packaged, but also which cannot be actuated and drained of its gas prior to purchase and which can be immediately recognized by a potential buyer as a fresh unused lighter.

SUMMARY OF THE INVENTION

These objects are attained according to the present invention by a lighter of the above-described general type which is provided with a shield surrounding the projecting part of the valve lever and preventing it from being actuated. Means such as a frangible web releasably connects this shield to the housing.

Before being torn off, this shield thus opposes any actuation of the valve lever, whether intentional or accidental during transportation and storage of this lighter.

According to a feature of the invention, the shield which may be torn off is constituted by a collar molded with the body of the lighter, to which it is connected by a plurality of small webs.

This shield advantageously comprises, below the operating end of the actuating lever for the burner valve, a lip immediately underlying and inhibiting any downward movement of the end of this lever.

According to another feature of the invention the head of the lighter is covered by a metal cap and the shield which may be torn off is constituted by an outer upper rim of part of the skirt of this cup-shaped cap to the lower edge of which it is connected by a plurality of webs which are formed in the original stamping of the cap.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
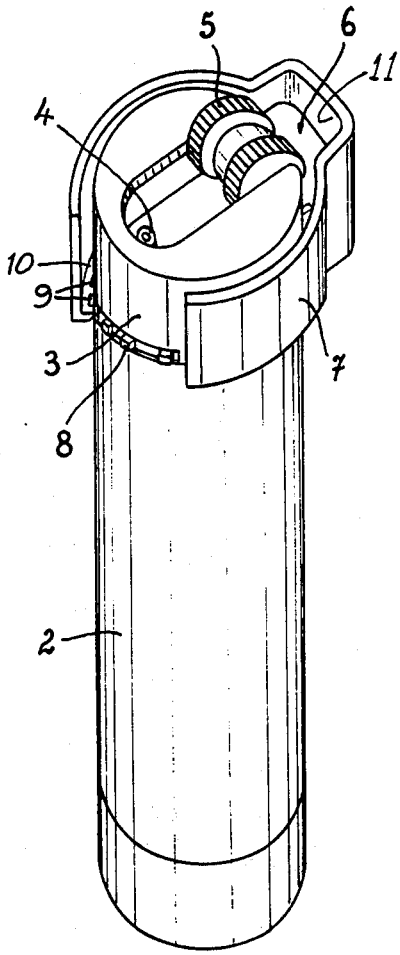
FIG. 1 is a perspective view of a lighter according to the present invention with the shield in place.
Figure 2:
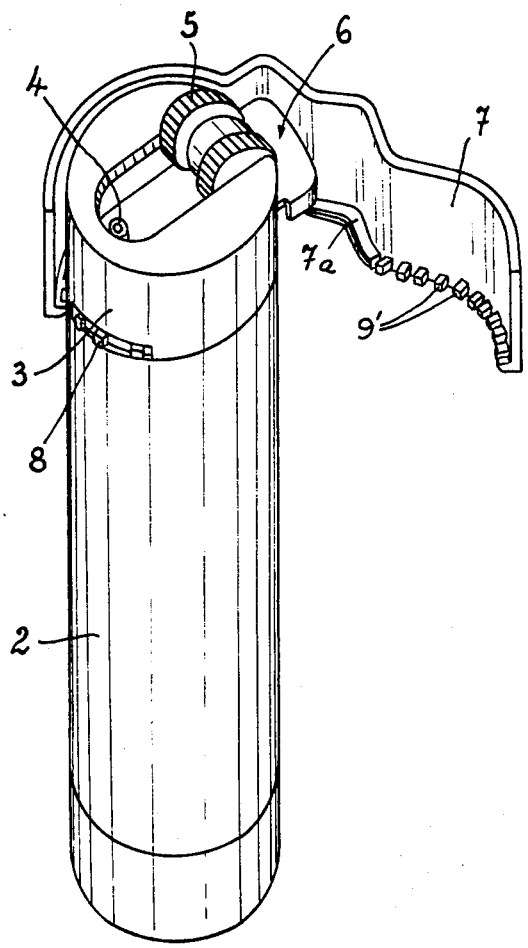
FIG. 2 is a perspective view of another lighter in accordance with the invention with the shield partly removed.

The lighter shown in FIGS. 1 and 2 is of the disposable type and comprises a synthetic-resin body 2 whose upper end constituting the head is covered by a metal cup-shaped cap which surrounds the burner valve 4, the striker wheel 5 and the operating end of the actuating lever 6 for the valve.

The cap 3 which covers the head of this lighter is surrounded by a collar 7 forming a shield for making this lighter inviolable and which, to this end, covers at least the operating end of the lever 6 for actuating the burner valve 4.

In FIG. 1 this shield 7 is unitary with the cap 3 of the lighter, to which it is connected by webs 9 extending inwardly from a lip 10 along at least part of its lower edge.

The shield forms a channel 11 open at an end and extending parallel to the length of the lighter for receiving the lever 6.

FIG. 2 shows how the part of the lower edge of the tab 7' located below the operating end of the lever 6 comprises a shoulder *7a* which inhibits any downward movement of said end of the lever 6.

In this example, the collar 7' does not surround the entire head of the lighter, but leaves a free space for actuation of the toothed wheel 8 provided for adjusting the flame height.

It is necessary to tear off the protecting shield 7' to be able to operate the lever 6 and consequently to use this lighter.

This tearing off action is facilitated owing to the fact that the protective tab and the end of the body 2 of the lighter are connected by a series of webs 9'. In FIG. 2 the shield 7' is made of synthetic-resin material molded in one piece with the body 2 of the lighter, and connected at the webs 9' adjacent the base of the cap 3 at least in the two parts of the latter which are not located opposite the operating end of the lever 6 and the knurled wheel 8.

It is impossible to provide the shoulder *7a* in the example of FIG. 1, since the shoulder *7a* would prevent mounting of the cup 3 on the head of the lighter.

I claim:

1. A lighter comprising:

an elongated housing having a cylindrical head and formed with a cylindrical reservoir containing a supply of fuel;

a burner on said head;

valve means on said head between said burner and said reservoir and having a laterally projecting lever actuatable for feeding said fuel to said burner;

a striker wheel on said head above said lever for igniting fuel issuing from said burner; and a shield extending around part of said head and formed with a channel open parallel to said housing and receiving said projecting lever and preventing actuation thereof, said shield comprising a pair of arc-segmental aprons extending around said head to opposite sides of said channel coaxial with said head and secured by spaced-apart webs to said housing, said webs being integral with said housing and said aprons, said shield having an inwardly directed lip immediately underlying said projecting lever.

* * * * *